United States Patent [19]

Rullier

[11] Patent Number: 4,639,011

[45] Date of Patent: Jan. 27, 1987

[54] SAFETY SKI BINDING

[75] Inventor: Pierre Rullier, Annecy, France

[73] Assignee: Salomon S.A., Annecy, France

[21] Appl. No.: 579,376

[22] Filed: Feb. 13, 1984

[30] Foreign Application Priority Data

Feb. 14, 1983 [FR] France ..... 83 02309

[51] Int. Cl.[4] ..... A63C 9/085

[52] U.S. Cl. ..... 280/628

[58] Field of Search ..... 280/625, 626, 628, 629, 280/634

[56] References Cited

U.S. PATENT DOCUMENTS

| | | | |
|---|---|---|---|
| 4,260,175 | 4/1981 | Salomon | 280/629 |
| 4,337,965 | 7/1982 | Salomon | 280/628 |
| 4,345,776 | 8/1982 | Salomon | 280/626 |
| 4,405,153 | 9/1983 | Salomon | 280/629 |

FOREIGN PATENT DOCUMENTS

| | | |
|---|---|---|
| 2334382 | 7/1977 | France . |
| 2420359 | 10/1979 | France . |
| 2478476 | 9/1981 | France . |

*Primary Examiner*—John J. Love
*Assistant Examiner*—Richard Camby
*Attorney, Agent, or Firm*—Sandler & Greenblum

[57] ABSTRACT

A safety ski binding and a method of laterally releasing the boot. The binding includes a jaw holding one end of the boot and adapted to laterally pivot, and a support fixed to the ski. The support forms two downwardly converging lines of support around which the jaw pivots. In one embodiment, the support comprises two projections positioned symmetrically with respect to the longitudinal and vertical plane of symmetry of the binding, and a third projection, below the first two projections which is positioned in the vertical and longitudinal plane of symmetry of the binding. Corresponding grooves on the jaw are biased to engage these projections by an elastic mechanism. Alternatively, the lines of support are formed by grooves on the support which engage corresponding projections on the jaw. In another embodiment, the projections and grooves are replaced by V-shaped ribs and grooves. These embodiments permit the binding to compensate for frictional forces which arise when the binding is vertically biased during lateral release.

57 Claims, 17 Drawing Figures

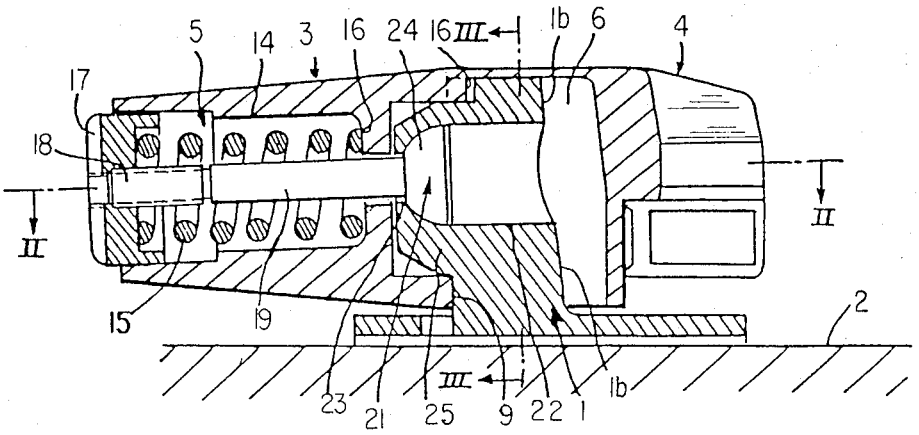
FIG. 1.
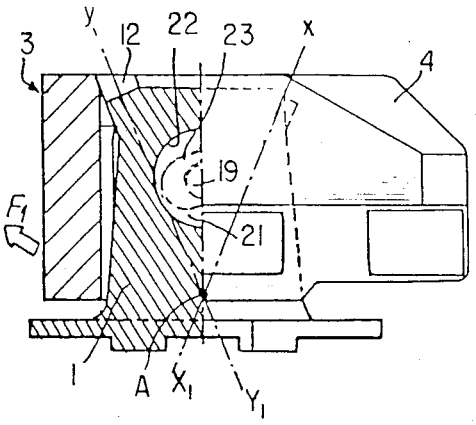
FIG. 3.
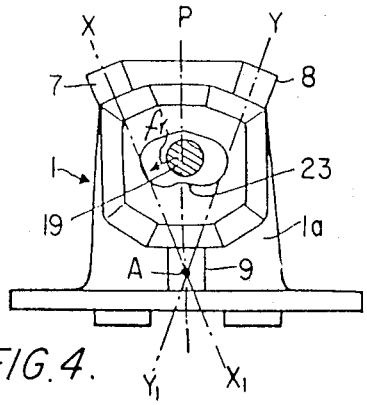
FIG. 4.
FIG. 2.
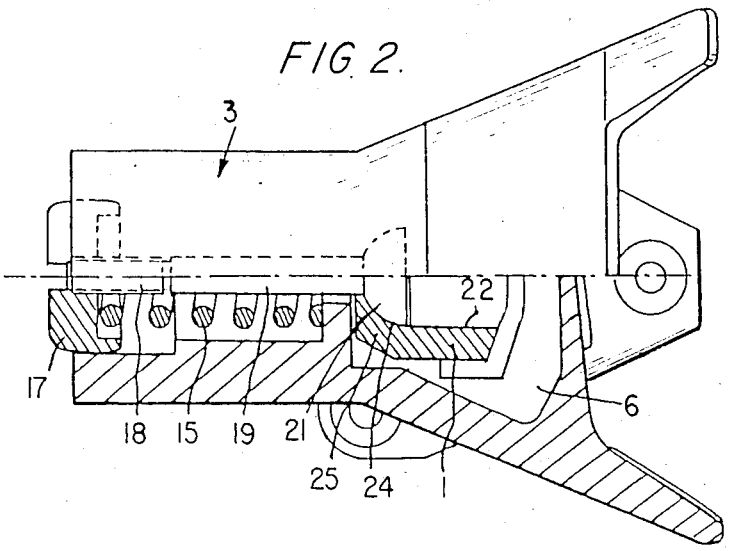

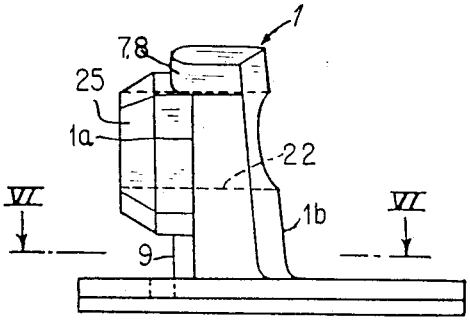
FIG. 5.
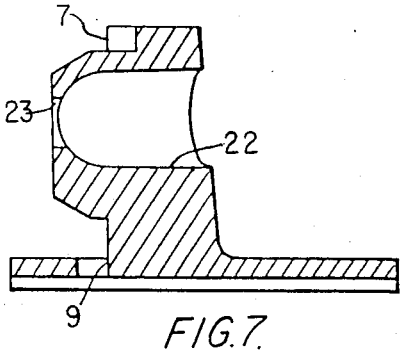
FIG. 7.
FIG. 6.
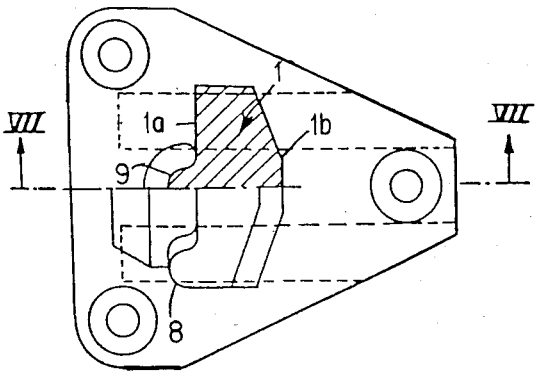
FIG. 8.
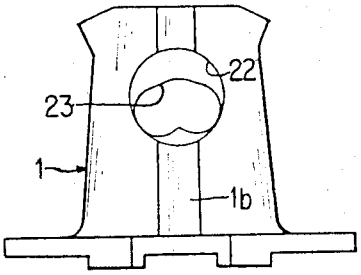

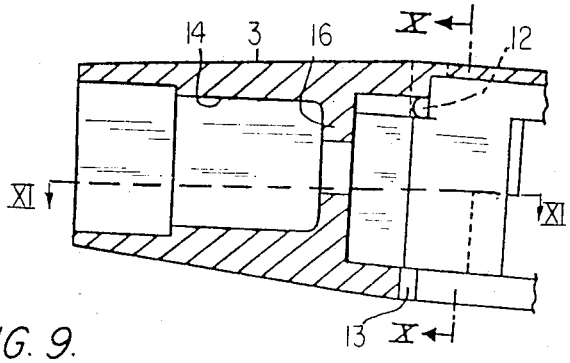
FIG. 9.
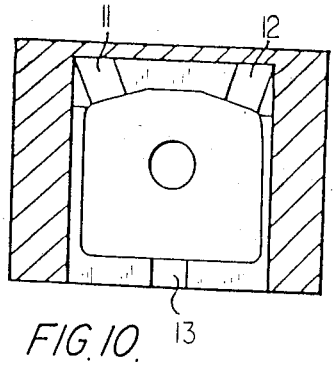
FIG. 10.
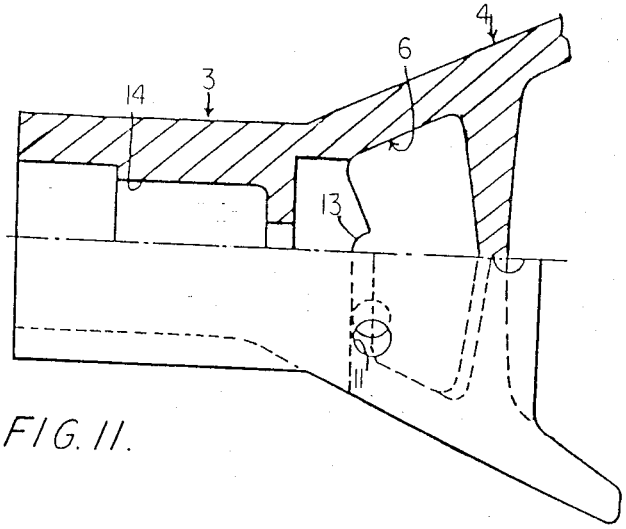
FIG. 11.
FIG. 12.
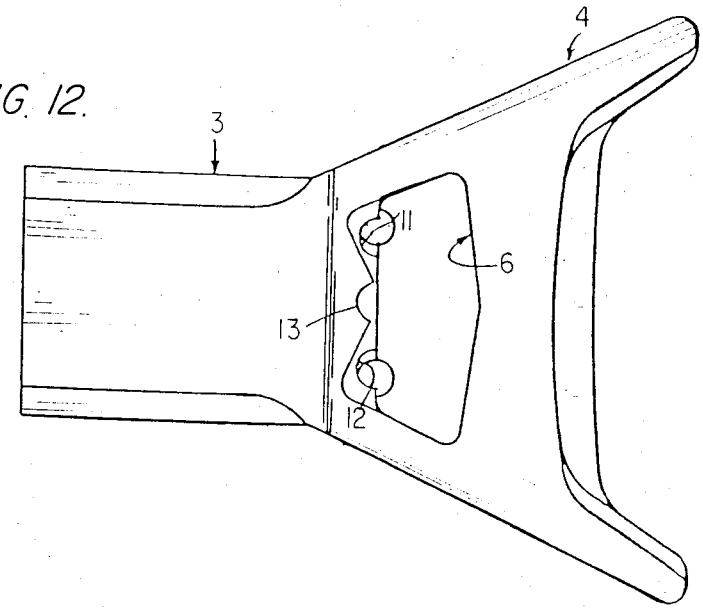

SAFETY SKI BINDING

BACKGROUND OF THE INVENTION

1. Field of the Invention

The present invention relates to a safety ski binding adapted to maintain, and laterally release one end of a boot with respect to the ski.

2. Description of Prior Art

"Abutment-type" ski bindings maintain one end of the boot on a ski and are adapted to permit lateral release of the boot in response to excessive torsional forces on the leg of the skier, thereby assuring the skier's safety. Lateral pivoting and release of the boot in this type of binding occurs against the bias of a preadjusted mechanism whose bias is adjusted to a predetermined value or threshold. When torsional forces on the leg exceed this predetermined threshold, the boot is laterally released.

This type of binding comprises a jaw having two displaceable lateral retention wings forming an integral assembly, and a support element attached to the ski, defining two lateral lines of support for the jaw. These lines of support are respectively positioned on either side of the longitudinal plane of symmetry of the ski such that the jaw can pivot around either of the support lines. An elastic energization mechanism biases the jaw towards the support element to maintain contact between the jaw and the support.

In certain known "abutment-type" safety bindings, the support lines are vertical, i.e., perpendicular to the upper surface of the ski. Such an arrangement is disadvantageous because in certain types of release it causes an increase in the amount of force necessary to release the boot, particularly when the binding is biased vertically in the course of lateral release. In effect, the sole is pressed under the edge of the jaw or the sole holder, and the support point is positioned at the same horizontal level. As a result, there is a substantial amount of friction between the sole and the lower edge of the jaw. This friction opposes lateral release and movement of the boot and jaw. Consequently, the amount of force necessary to laterally release the boot increases, thereby interfering with the proper operation of the binding.

To overcome this problem, a binding has previously been developed in which the support lines converge at a point located above the ski. Such a safety binding is described, for example, in French Patent No. 75 37 908 belonging to applicant. By virtue of the upwardly converging support lines of the jaw, the jaw rises slightly during its pivoting around one of the lines of support in the direction of its lateral pivoting and release. This upward movement of the jaw practically eliminates the friction resulting from the vertical biasing of the binding during the lateral release, thereby eliminating the detrimental increase in the force necessary to release the boot.

SUMMARY OF THE INVENTION

The present invention provides another apparatus and method for compensating for the friction resulting from the vertical biasing of the binding during a lateral release. The safety ski binding of the present invention has a particularly simple structure and permits pivoting of the jaw around lateral converging support lines and also permits longitudinal movement of the jaw toward and away from the support element.

The safety ski binding which accomplishes these goals comprises a jaw adapted to retain and laterally release one end of a boot, and a support element attached to the ski. The support element defines two laterally converging lines of support for the jaw, around which the jaw may laterally pivot. The binding further comprises an elastic energization mechanism which biases the jaw against the two laterally converging support lines. Furthermore, the two lateral support lines are provided on a transverse surface of the support element which is opposite from the surface of the support which faces the jaw. The two lateral support lines converge in the direction of the ski.

In another embodiment, the invention comprises a safety ski binding adapted to releasably hold one end of a ski boot to a ski. The binding comprises a jaw, adapted to hold one end of a boot and adapted to laterally pivot. In addition, the binding comprises a support, adapted to be fixed to the ski. The support comprises two downwardly converging lines of support such that the jaw is adapted to laterally pivot around either of these two downwardly converging lines of support. The lines of support may converge toward the ski. The jaw lifts away from the ski as the jaw laterally pivots around either line of support.

The binding also comprises an elastic means for biasing the jaw and support into contact with each other. In one embodiment, the elastic means biases the jaw against the support. In this embodiment the support comprises a portion comprising the lines of support, and the elastic means continuously maintains a portion of the jaw in contact with this portion of the support and at least one of the lines of support. In addition, the jaw is adapted to be positioned in a rest position in which the longitudinal axis of the jaw is substantially parallel to the longitudinal axis of the ski. The elastic means is adapted to maintain the jaw in contact with both lines of support on the support when the jaw is in the rest position.

The jaw has a cavity therein adapted to receive the support. In this embodiment the jaw further comprises anterior and posterior portions on opposite sides of the cavity. In addition, the jaw also comprises a means for holding the boot, which is positioned on the posterior portion of the jaw. The anterior portion of the jaw comprises a surface which the elastic means biases against the anterior portion of the support.

In one embodiment, the anterior portion of the support comprises first and second projections positioned symmetrically with respect to the vertical and longitudinal plane of symmetry of the binding. The anterior portion of the support also comprises a third projection, spaced below the first and second projections and positioned in the vertical and longitudinal plane of symmetry of the binding. In addition, in this embodiment, the surface on the anterior portion of the jaw comprises first and second grooves, adapted to engage the first and second projections, respectively, and a third groove adapted to engage the third projection. These projections comprise the two lines of support. More specifically, the first and third projection comprise one of the lines of support around which the jaw pivots, and the second and third groove and the second and third projection comprise the other line of support around which the jaw laterally pivots. In addition, the first and second projections are laterally spaced apart and are at substantially the same vertical height. Also, the projections on the support are in substantially the same transverse plane.

In an alternative embodiment, the anterior portion of the support comprises first and second grooves, positioned symmetrically with respect to the longitudinal and vertical plane of symmetry of the binding, and a third groove, spaced below the first and second grooves. The third groove is positioned in the vertical and longitudinal plane of symmetry of the binding. In this embodiment, the surface on the anterior portion of the jaw comprises first and second projections, adapted to engage the first and second grooves, respectively, and a third projection, adapted to engage the third groove. These grooves comprise the two lines of support. More specifically, the first and third groove comprise one of the lines of support, and the second and third groove comprise the other line of support.

In an alternative embodiment, the anterior portion of the support comprises two elements, having a V-shaped configuration. These two elements are positioned symmetrically with respect to the longitudinal and vertical plane of symmetry of the binding. In addition, in this embodiment, the surface on the anterior portion of the jaw comprises two complementary elements, also having a V-shaped configuration. These complementary elements are adapted to engage the two elements on the anterior portion of the support. The two V-shaped elements on the support comprise the two lines of support. In one embodiment, the two elements on the support are projections and the two elements on the jaw are grooves. Alternatively, the two elements on the support may be grooves and the two elements on the jaw may comprise projections.

The jaw may also comprise an anterior portion having an axial bore therein which houses the elastic means, in the form of a compression spring. In this embodiment, the jaw may further comprise a wall having first and second sides, the first side of which comprises one end of the axial bore, and the second side of which is adjacent to an anterior portion of the support. In this embodiment, the compression spring contacts the first side of the wall. As a result of pressure of the spring against the first side of this wall, the second side of the wall is biased against the anterior portion of the support.

The anterior portion of the jaw may further comprise a cap at the opposite end of the bore from the wall. One end of the spring contacts the wall and the other end of the spring contacts the cap. The cap may comprise means for adjusting the tension in the spring. This is accomplished by providing threads on the cap, and further providing a shaft positioned in the axial bore and having a threaded end adapted to receive the threaded cap thereon. By rotating the threaded cap on the end of the threaded shaft, the longitudinal position of the cap may be changed, thereby increasing or decreasing the "stiffness" of the spring.

The support may further comprise a posterior portion and an opening therein, extending from this posterior to the anterior portion of the support. In addition, the shaft further comprises an expanded head at the end of the shaft opposite from threaded end. This expanded head is adapted to engage the opening in the support. This opening is formed axially and horizontally in the support element. In addition, the end of this opening which is adjacent to the anterior portion is substantially hemispherical in shape, as is the expanded head. As a result of the substantially hemispherical shape of the expanded head and the opening, these elements together comprise means for permitting the shaft to follow the vertical and lateral movement of the jaw.

In addition, a portion of the opening adjacent to the anterior surface of the support is substantially bean-shaped. This portion of the opening has two downwardly inclined lateral arms.

In another embodiment, the elastic means is positioned on the exterior of the jaw. In this embodiment, the jaw comprises an anterior portion having a posterior side adjacent to the support and an anterior side. The elastic means is adapted to contact the anterior side of this anterior portion so as to bias the posterior side against the support. The elastic means may comprise a spring and a piston. The spring biases the piston against the anterior side of the jaw. In addition, the elastic system further comprises a base plate attached to the ski. This base plate also attaches the support to the ski. In addition, the elastic system further comprises a body, integral with the base plate. The body has a longitudinal bore which houses the spring and piston and in which this piston is slidingly mounted. This longitudinal bore is threaded at one end and is adapted to receive a threaded adjustment cap threaded at one end of the bore for adjusting the tension in the spring. In addition, the support comprises a notch on the anterior surface thereof. In addition, the posterior side of the anterior portion of the jaw comprises a projection adapted to engage this notch to vertically retain the jaw.

In still another embodiment, the invention comprises a safety ski binding for connecting one end of the boot to a ski. In this embodiment, the binding comprises means for holding one end of the boot. In addition, the binding also comprises means for pivoting this holding means around either one of two downwardly converging lines of support during the lateral pivoting of the holding means. As the holding means pivots laterally, it lifts away from the ski. The pivoting means comprises means for compensating for the friction arising between the boot and the holding means when the holding means experiences a vertical force during lateral pivoting.

In addition, the pivoting means may further comprise a support fixed to the ski. In this embodiment, the pivoting means comprises at least two elements of the support. In addition at least two complementary elements are provided on the holding means. Each of the at least two complimentary elements of the holding means each is adapted to engage a different one of the elements of the support. The two elements of the support comprise these two downwardly converging lines of support. In one embodiment, the elements of the support and the elements of the holding means comprise first and second elements, positioned symmetrically with respect to the longitudinal and vertical axis of the binding, and a third element, positioned below the first and second elements, and positioned in the vertical and longitudinal plane of symmetry of the binding. In this embodiment, the first, second and third elements of the support may be projections and the first, second and third elements of the holding means may be grooves. Alternatively, the first, second and third elements of the support may be grooves, and the first, second and third elements of the holding means may be projections. In still another embodiment, the elements of the support and the holding means can have a V-shaped configuration, each leg of the V being positioned symmetrically with respect to the vertical and longitudinal plane of symmetry of the binding.

The pivoting means further comprises an elastic means for biasing the at least two elements of the holding means and the support into contact with each other. In one embodiment, the elastic means may act on the holding means. In this embodiment, the holding means may comprise an axial bore for housing the elastic means. In addition, the support may comprise an anterior portion which comprises the at least two elements, and the holding means may further comprise a wall having first and second sides. The first side may comprise one end of the axial bore against which the elastic means presses, and the second side may be positioned adjacent to the anterior portion of the support and may comprise the at least two embodiments of the holding means. In an alternative embodiment, the elastic means may be positioned on the exterior of the holding means.

The invention also comprises a method of laterally releasing a boot attached to a ski by a binding. The method comprises the steps of: holding the boot with a jaw; biasing the jaw into contact with a support, fixed to the ski; and laterally pivoting the jaw around either one of two downwardly converging lines of support formed by the jaw and support. The method may further comprise the step of laterally pivoting the jaw around either one of the two downwardly converging lines of support each of which is positioned symmetrically with respect to the vertical and longitudinal plane of symmetry of the binding.

In addition, the jaw may comprise a cavity and an anterior wall, forming one end of the cavity. The wall may have anterior and posterior sides. In addition, the support may comprise an anterior portion. In this embodiment, the method further comprises the step of biasing the jaw into contact with the support by rearwardly biasing the anterior side of the wall such that the posterior side of the wall contacts the anterior portion of the support.

In another embodiment, the invention comprises the support itself, having the characteristics discussed above.

BRIEF DESCRIPTION OF THE DRAWINGS

The invention will now be described by way of non-limiting example with reference to the attached drawings, in which:

FIG. 1 is a vertical and axial cross-sectional view of a first embodiment of a safety binding according to the invention;

FIG. 2 is a view which is half planar and half in horizontal cross-section along line II—II of FIG. 1;

FIG. 3 is a view, of the binding, half of which is a transverse cross-section along the line III—III of FIG. 1, and half of which is a front view, taken on the right of FIG. 1;

FIG. 4 is an elevational view of the support element taken from the left of FIG. 1;

FIG. 5 is a profile view of the support element;

FIG. 6 is a view of the support element, half of which is a horizontal cross-section taken along line VI—VI of FIG. 5 and half of which is a planar view;

FIG. 7 is a cross-sectional view taken along line VII—VII of FIG. 6;

FIG. 8 is an elevational view of the support element taken along the right of FIG. 1;

FIG. 9 is a vertical and partial axial cross-sectional view of the pivoting body which comprises the jaw;

FIG. 10 is a transverse cross-sectional view along line X—X of FIG. 9;

FIG. 11 is a view, half of which is a horizontal cross-sectional view along line XI—XI of FIG. 9;

FIG. 12 is a bottom view of the pivoting body assembly;

DESCRIPTION OF PREFERRED EMBODIMENTS

Figure 13:
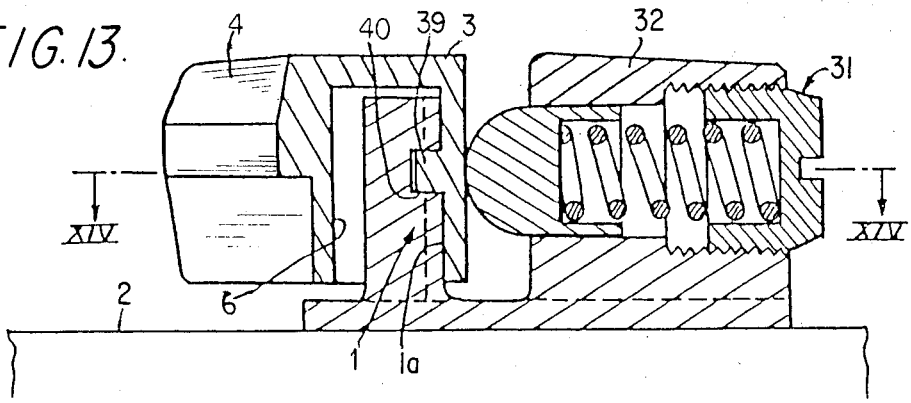
FIG. 13 is an axial and vertical cross-sectional view of a second embodiment of a safety ski binding according to the invention.

The first embodiment of the safety ski binding according to the invention is shown in FIGS. 1–3. It comprises a support element 1 attached to the upper surface of a ski 2 by means of screws. Openings in the base of support 1 for these screws are seen in FIG. 6. A body 3 is mounted on support element 1 so that it can pivot laterally on support 1. Body 3 comprises, at its posterior portion, a jaw 4 adapted to hold the anterior end of a ski boot (not shown). Body 3 and jaw 4 together comprise a laterally pivotable assembly which can be referred to generally as the jaw of the binding. Such a safety binding is known as a "front abutment" type binding. Jaw 4 can form a single rigid element with pivoting body 3 or it can be composed of lateral retention wings inserted in and journalled on body 3.

Pivoting body 3 is maintained in a rest position, in contact with support element 1, by an elastic energization mechanism 5 against which lateral pivoting and safety release occurs. The rest position of body 3 is defined as the position in which the longitudinal axis of body 3 is substantially parallel to the longitudinal axis of the ski. In order for body 3 to laterally pivot away from the rest position, the bias of mechanism 5 must be overcome.

The assembly formed by pivoting body 3 and jaw 4 comprises a cavity 6 in the lower surface of body 3 and in which support element 1 is adapted to be engaged. Thus, body 3 covers, to some extent, support element 1. This assembly has a posterior portion comprising jaw 4 on one side of cavity 6, and an anterior portion, on the other side of cavity 6.

According to the invention, pivoting body 3, which supports jaw 4 on the posterior side thereof, is biased against anterior surface 1*a* of support 1 by means of elastic energization mechanism 5. More specifically, mechanism 5 biases a surface of body 3 on the anterior portion thereof, which is opposite to the anterior edge of the ski boot, against support 1. Body 3 is pressed against support element 1 along one of two support lines $xx_1$ and $yy_1$ which converge in the direction of the ski, as can be best seen in FIG. 4. In a non-limiting embodiment, seen in FIG. 4, the two lateral support lines $xx_1$ and $yy_1$ are formed by two upper projections 7 and 8 provided on the anterior surface 1*a* of support element 1. Projections 7 and 8 and support lines $xx_1$ and $yy_1$ are positioned symmetrically with respect to the vertical and longitudinal plane of symmetry P of the binding, and with respect to a single lower projection 9 positioned in plane P. Support line $xx_1$ is defined by the alignment of projections 7 and 9 while support line $yy_1$ is defined by the alignment of projections 8 and 9. The two lines of support converge at a point A on the lower projection 9. The three projections 7, 8 and 9 are preferably molded together with support element 1 and they are preferably positioned in the same transverse plane as each other.

Three grooves 11, 12 and 13 are provided on the anterior side of a wall which defines the anterior surface of cavity 6. The two upper grooves 11 and 12 are respectively, adapted to engage upper projections 7 and 8 and, the lower central groove 13 is adapted to engage lower projection 9 under the bias of mechanism 5.

The biasing of pivoting body 3 against anterior surface 1*a* of support element 1 can occur by any appropriate means known to those skilled in the art. In the non-limiting embodiment shown in FIGS. 1–4, elastic energization mechanism 5 performs this function. Mechanism 5 comprises a compression spring 15 positioned within an axial bore 14 in the anterior portion of body 3. Compression spring 15 extends frontwardly, in axial bore 14, and is supported, at one end, on the transverse end 16 of bore 14, positioned near support element 1. Transverse end 16 is the posterior side of a wall of body 3. The other side of this wall comprises grooves 11, 12 and 13. Spring 15 is supported, at its other end, on a cap 17 which blocks the exterior orifice of bore 14. Cap 17 is screwed on threaded end 18 of an axial shaft 19 which comprises a retaining bolt. The other or posterior end of shaft 19 comprises an expanded head 21 which engages an opening 22 formed axially and horizontally in support element 1. As seen in FIG. 7, opening 22 extends from posterior surface 1*b* of support element 1 to anterior surface 1*a* of support element 1. Opening 22 communicates with anterior surface 1a by means of an opening 23 which is traversed by shaft 19. Opening 23 is substantially in the shape of a bean having two lateral arms inclined downwardly to allow for the lateral downward displacement of retaining bolt 19 during a release of the binding as seen in FIGS. 4 and 8. Head 21 of retaining bolt 19 has an external surface 24 which is substantially hemispherical in shape. One end of opening 22 is also substantially hemispherical in shape and surface 24 is supported on this end of opening 22.

As is apparent from the description above, the force of spring 15 is transferred to transverse end 16 of bore 14 of body 3. As a result, body 3 is biased against anterior surface 1*a* of support element 1. More specifically grooves 11, 12 and 13 are biased against projections 7, 8, 9 defining the two converging support lines $xx_1$ and $yy_1$. In addition, as a result of the reaction force exerted by spring 15, retaining bolt 19 is biased frontwardly and consequently, hemispherical surface 24 of head 21 is biased against the end of opening 22.

Support element 1 is preferably provided, on its anterior surface 1*a*, with a protuberance 25 which is positioned between upper projections 7 and 8, and lower projection 9. Projection 25 is thus positioned so as to project frontwardly with respect to the projections. The end of opening 22 which receives head 21 is positioned in protuberance 25.

During lateral pivoting and release, the assembly formed by body 3 and jaw 4 pivots left or right around one of the lateral support lines $xx_1$ or $yy_1$. Because the lateral support lines converge downwardly on the anterior surface 1*a* of support element 1, there is a slight lifting of jaw 4 as jaw 4 laterally pivots. This lifting of jaw 4 compensates for spurious friction between the sole of the boot and the jaw. For example, if the front of the boot is subjected to a leftward torsion, jaw 4 and body 3 tend to pivot around lateral support line $xx_1$ along the direction of arrow $f_1$ in FIG. 3 and the left wing of jaw 4 rises during this pivoting, due to the inclination of support line $xx_1$. During this movement, retaining bolt 19 descends slightly in the lateral arm of opening 23 opposite from the direction of pivoting along arrows $f_1$ of FIG. 4. This movement of shaft 19 is possible because of the particular bean configuration of opening 23.

Furthermore, because of the lateral support lines $xx_1$ and $yy_1$ on anterior surface 1*a* of the support element and the rearward bias of body 3, the assembly of body 3 and jaw 4 can be slightly displaced in the forward direction against the return force exerted by spring 15 of energization mechanism 5.

Figure 16:
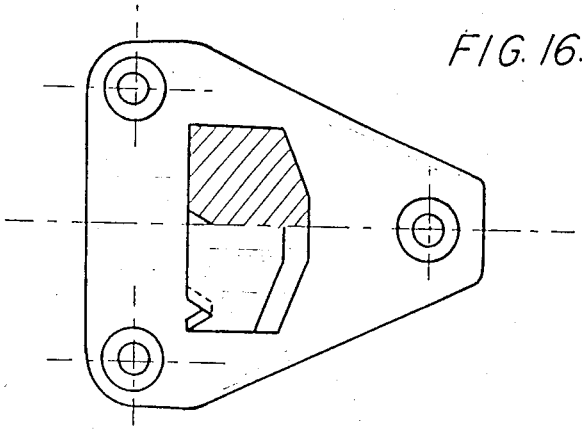
FIG. 16 is a top view of another embodiment of the support, in which the support has V-shaped notches that form the support lines.
Figure 17:
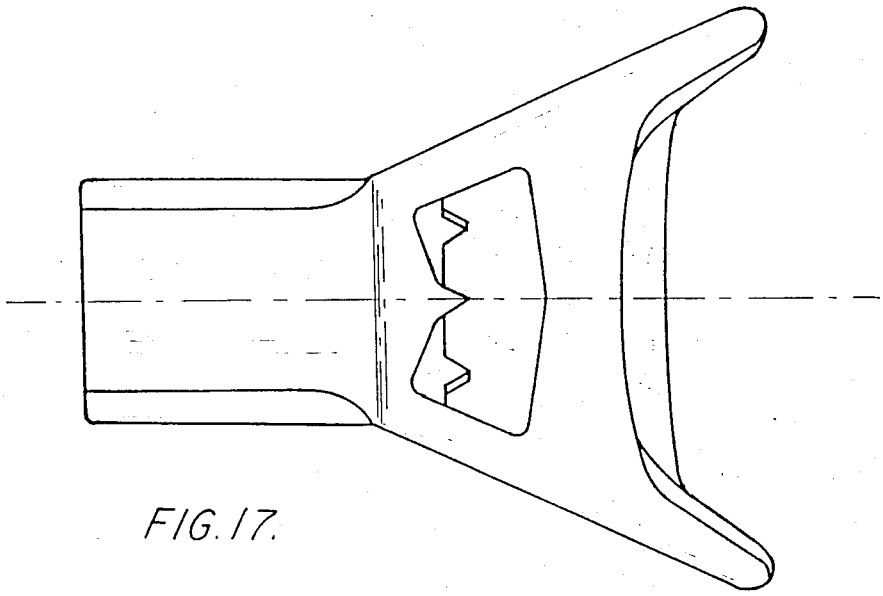
FIG. 17 is a bottom view of another embodiment of the jaw illustrating V-shaped projections which comprise support lines.

In the particular embodiment described above by way of example, the two converging lateral support lines $xx_1$ and $yy_1$ are formed by two upper projections 7 and 8 and a lower projection 9 with which corresponding grooves 11, 12, and 13 on body 3 cooperate. It is, however, within the scope of the invention to adopt the reverse arrangement, i.e., support element 1 comprises, instead of projections 7, 8 and 9, the corresponding grooves, as seen in FIG. 16, while body 3 comprises, projections facing these grooves, adapted to engage therein, as seen in FIG. 17.

The projections defining the lateral support lines can have any shape, such as spherical, conical, cylindrical, cubic, etc.

According to another embodiment, the lateral converging support lines $xx_1$ and $yy_1$ are defined by the cooperation of two V-shaped ribs provided on support element 1 or body 3 with complementary V-shaped grooves provided on body 3 or support element 1. FIG. 16 illustrates V-shaped notches on support element 1 and FIG. 17 illustrates V-shaped projections on body 3.

It should be noted that energization mechanism 5 comprises retention bolt 19 which extends axially in the anterior portion of body 3. Hemispherical surface 24 of head 21 of retention bolt 19 is provided so as to function, at the end of opening 22, as a universal journal, allowing retention bolt 19 to follow all possible movements of body 3, (i.e., both lateral and vertical movements), during the lateral release of the binding. Cap 17 which is screwed onto threaded portion 18 of retention bolt 19 makes it possible to adjust the tension of spring 15 and consequently to adjust the "stiffness" of the binding.

Figure 14:
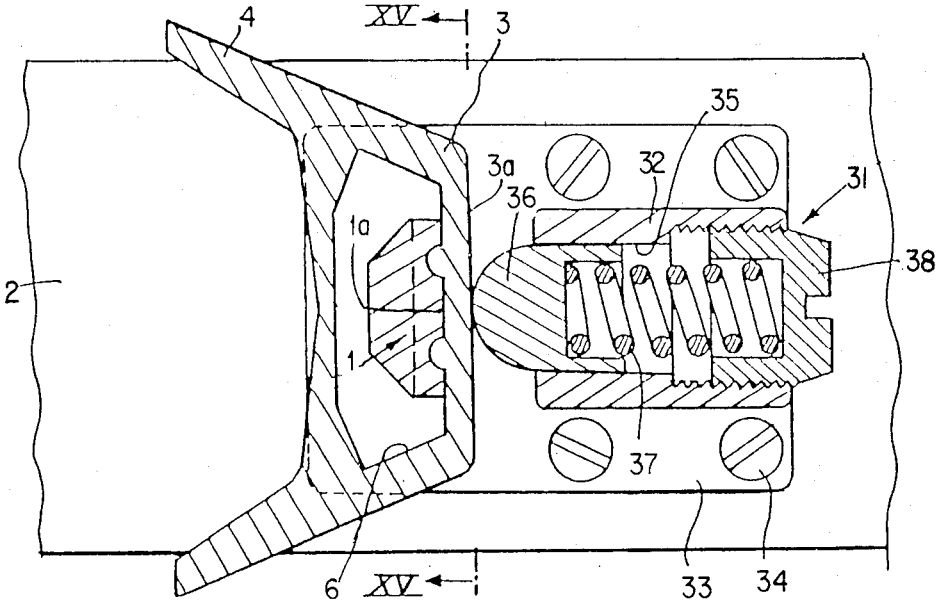
FIG. 14 is a horizontal cross-sectional view along line XIV—XIV of FIG. 13.
Figure 15:
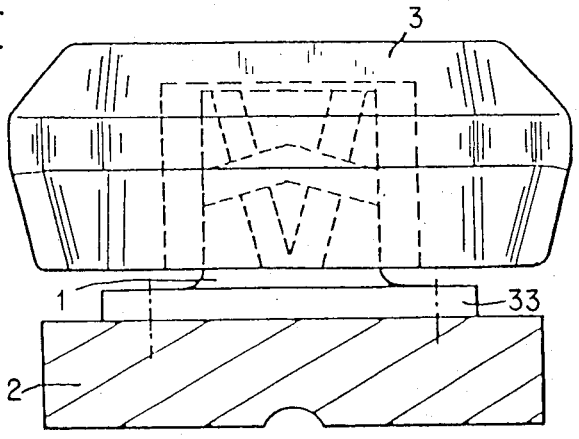
FIG. 15 is a transverse cross-sectional view along line XV—XV of FIG. 14.

In a second embodiment of the invention which is illustrated in FIGS. 13–15, the elastic energization mechanism which presses body 3 and jaw 4 (which is integral with body 3) against anterior surface 1a of support element 1 is formed independently of body 3 on the exterior thereof. This elastic energization mechanism designated in its entirety by reference 31, comprises a body 32 integral with a base plate 33 attached to the ski by means of screws 34. Base plate 33 also attaches support element 1 to ski 2. Body 32 is positioned slightly in front of support element 1 and is bored on both sides with a bore 35. The longitudinal axis of bore 35 is substantially parallel to the longitudinal axis of the ski. A piston 36 is slidably mounted in bore 35. Therefore, piston 36 is adapted to reciprocate along the longitudinal axis of bore 35 and ski 2. In addition, piston 36 is adapted to contact the anterior transverse surface 3a of the anterior portion of pivoting body 3. Piston 36 is biased and pushed rearwardly onto surface 3a by a compression spring 37 positioned in bore 35. Spring 37 is supported on one end by an adjustment cap 38 screwed in threaded walls provided in the anterior portion of bore 35.

It is evident from the preceeding description that the pivoting assembly body 3 and jaw 4 is maintained and pressed against anterior surface 1*a* of support element 1 under the action of energization mechanism 31 as in the first embodiment. More specifically, the posterior side of the anterior portion of body 3 contacts anterior surface 1a of support element 1.

In the binding illustrated in FIGS. 13–15, the pivoting assembly 3 and 4 can be retained against vertical movement by engaging a projection 39, protruding from anterior transverse surface 3*a* of body 3, in a notch 40 provided in anterior surface 1*a* of support element 1. Projection 39 projects into cavity 6 when this occurs.

Although the invention has been described with reference to particular means, materials and embodiments, it is to be understood that the invention is not limited to the particulars disclosed and extends to all equivalents included within the scope of the claims.

What is claimed is:

1. A safety ski binding adapted to releasably hold one end of a ski boot on a ski, wherein said binding comprises at least two elements comprising:

(a) a jaw comprising a portion adapted to hold one end of said boot and adapted to laterally pivot; and (b) a support, adapted to be fixed to said ski, wherein said support comprises first and second surfaces, wherein said first surface faces said portion of said jaw and said second surface is opposite from said first surface, wherein said support further comprises two downwardly converging lines of support on said second surface, wherein said jaw is adapted to laterally pivot around either one of said two lines of support, wherein each of said lines of support comprises one of the members of the following group:

at least one groove and at least one projection, wherein said jaw comprises the other of the members from said group, wherein said at least one groove on one of said elements of said binding engages said at least one projection on the other of said elements of said binding during lateral pivoting of said jaw around said lines of support.

2. The binding defined by claim 1 wherein said binding further comprises:

(c) elastic means for biasing said jaw and support into contact with each other.

3. The binding defined by claim 2 wherein said elastic means biases said jaw against said support.

4. The binding defined by claim 3 wherein said support comprises a portion comprising said lines of support, and wherein said elastic means continuously maintains a portion of said jaw in contact with at least one of said lines of support on said portion of said support.

5. The binding defined by claim 4 wherein said jaw is adapted to be positioned in a rest position in which the longitudinal axis of said jaw is substantially parallel to the longitudinal axis of said ski, and wherein said elastic means maintains said jaw in contact with both lines of support on said support in said rest position.

6. The binding defined by claim 3 wherein said jaw comprises a cavity therein, adapted to receive said support, and wherein said jaw further comprises an anterior and posterior portion on opposite sides of said cavity.

7. The binding defined by claim 6 wherein said support comprises anterior and posterior portions and said jaw further comprises:

(i) means for holding said boot, positioned on said posterior portion of said jaw; and (ii) a surface on said anterior portion of said jaw, wherein said elastic means biases said surface against said anterior portion of said support.

8. The binding defined by claim 7 wherein said lines of support converge toward said ski, and said jaw lifts away from said ski as said jaw laterally pivots.

9. The binding defined by claim 7 wherein said anterior portion of said support comprises:

(i) first and second projections positioned symmetrically with respect to the vertical and longitudinal plane of symmetry of said binding; and (ii) a third projection, spaced below said first and second projections and positioned in said vertical and longitudinal plane of symmetry of said binding, and wherein said surface on said anterior portion of said jaw comprises:

(i) first and second grooves, adapted to engage said first and second projections, respectively, and (ii) a third groove, adapted to engage said third projection, wherein said projections comprises said two lines of support.

10. The binding defined by claim 9 wherein said first and third projection comprises one of said lines of support, and wherein said second and third projection comprise the other line of support.

11. The binding defined by claim 9 wherein said first and second projections are laterally spaced apart and are at substantially the same vertical height.

12. The binding defined by claim 9 wherein said projections are in the same transverse plane.

13. The binding defined by claim 7 wherein said anterior portion of said support comprises:

(i) a first and second groove, positioned symmetrically with respect to the vertical and longitudinal plane of symmetry of said binding; and (ii) a third groove, spaced below said first and second grooves and positioned in the vertical and longitudinal plane of symmetry of said binding, and wherein said surface on said anterior portion of said jaw comprises:

(i) first and second projections, adapted to engage said first and second grooves, respectively; and (ii) a third projection, adapted to engage said third groove, wherein said grooves comprise said two lines of support.

14. The binding defined by claim 13 wherein said first and third groove comprises one of said lines of support, and wherein said second and third grooves comprise the other line of support.

15. The binding defined by claim 7 wherein said anterior portion of said support comprises two elements, having a V-shaped configuration, wherein said two elements are positioned symmetrically with respect to the vertical and longitudinal plane of symmetry of said binding, and wherein said surface on the anterior portion of said jaw comprises two complementary elements, having a V-shaped configuration and adapted to engage said two elements on said anterior portion of said support, wherein said two V-shaped elements on said support comprise said two lines of support.

16. The binding defined by claim 15 wherein said two elements on said support are projections and said two elements on said jaw comprise grooves.

17. The binding defined by claim 15 wherein said two elements on said support are grooves, and said two elements on said jaw comprises projections.

18. The binding defined by claim 2 wherein said jaw comprises an anterior portion having an axial bore therein and said elastic means comprises a compression spring positioned in said axial bore.

19. The binding defined by claim 18 wherein said support comprises an anterior portion, and said jaw further comprises a wall having first and second sides, said first side comprising one end of said axial bore, and wherein said second side is adjacent said anterior portion of said support, and wherein one end of said spring contacts said first side of said wall.

20. The binding defined by claim 19 wherein said anterior portion of said jaw further comprises a cap at the opposite end of said bore from said wall, and wherein the other end of said spring contacts said cap, and wherein said cap comprises means for adjusting the tension in said spring.

21. The binding defined by claim 20 wherein said cap is threaded and said jaw further comprises a shaft, positioned in said axial bore and having a threaded end adapted to receive said threaded cap thereon.

22. The binding defined by claim 21 wherein said support further comprises a posterior portion, and an opening therein, extending from said posterior to said anterior portion, and wherein said shaft further comprises an expanded head, at the other end thereof, adapted to engage said opening of said support.

23. The binding defined by claim 22 wherein said opening is formed axially and horizontally in said support element.

24. The binding defined by claim 23 wherein said opening has a first end adjacent said anterior portion, and said expanded head and said first end of said opening adjacent said anterior portion both have a substantially hemispherical shape.

25. The binding defined by claim 22 wherein said jaw is adapted to be displaced vertically and wherein said expanded head and said opening comprise means for permitting said shaft to follow the vertical and lateral movement of said jaw.

26. The binding defined by claim 22 wherein a portion of said opening adjacent said anterior surface of said support is substantially bean-shaped.

27. The binding defined by claim 22 wherein a portion of said opening adjacent said anterior surface of said support has two downwardly inclined lateral arms.

28. The binding defined by claim 2 wherein said jaw comprises an anterior portion having a posterior side adjacent said support and an anterior side, and, wherein said elastic means is positioned on the exterior of said jaw and contacts said anterior side.

29. The binding defined by claim 28 wherein said elastic means comprises a spring and piston, wherein said spring biases said piston against said anterior side.

30. The binding defined by claim 29 wherein said elastic means further comprises:

(i) a base plate attached to said ski and wherein said base plate also attaches said support to said ski; and (ii) a body, integral with said base plate, having a longitudinal bore housing said spring and piston, and in which said piston is slidingly mounted.

31. The binding defined by claim 30 wherein said longitudinal bore is threaded at one end and wherein said elastic means further comprises a threaded adjustment cap threaded at said one end of said bore for adjusting the tension of said spring.

32. The binding defined by claim 30 wherein said support comprises an anterior surface and a notch on said anterior surface, and said posterior side of said anterior portion of said jaw comprises a projection adapted to engage said notch to vertically retain said jaw.

33. A safety ski binding, for connecting one end of a boot to a ski, wherein said binding comprises:

(a) means for holding one end of said boot comprising a portion adapted to engage said boot; and (b) means for pivoting said holding means around either of two downwardly converging lines of support during lateral pivoting of said holding means, wherein said pivoting means comprises first and second surfaces, wherein said first surface faces said portion of said holding means, wherein said second surface is opposite from said first surface, wherein said pivoting means further comprises first, second and third portions on said second surface and comprising said downwardly converging lines of support and wherein said holding means comprises first, second and third complementary portions, each of which is adapted to engage a different one of said portions of said pivoting means, wherein said portions of said pivoting means and said portions of said holding means comprise:

(i) first and second elements, positioned symmetrically with respect to the vertical and longitudinal plane of symmetry of said binding; and (ii) a third element, positioned below said first and second elements, and positioned in the vertical and longitudinal plane of symmetry of said binding.

34. The binding defined by claim 33 wherein said pivoting means comprises means for compensating for friction arising between said boot and said holding means when said holding means experiences a vertical force during lateral pivoting of said boot.

35. A support for a ski binding adapted to engage a jaw holding a boot on a ski wherein said jaw is adapted to laterally pivot and wherein said support comprises:

(a) means for attaching said support to a ski; and (b) a surface having two downwardly converging lines of support thereon comprising means for pivoting said jaw around either one of said two lines of support, wherein each line of support forms less than a fourty five degree angle with a vertical axis passing through said support and wherein said each line of support comprises one of the following : at least one groove and at least one projection.

36. The support defined by claim 35 in combination with said jaw, wherein said support and said jaw together comprise a safety ski binding for releasably holding one end of a ski boot on a ski.

37. The binding defined by claim 33 wherein said pivoting means comprises a support fixed to said ski wherein said first, second and third elements of said support are projections, and said first, second and third element of said holding means are grooves.

38. The binding defined by claim 33 wherein said pivoting means comprises a support fixed to said ski wherein said first, second and third elements of said support are grooves, and said first, second and third elements of said holding means are projections.

39. The binding defined by claim 33 wherein said pivoting means comprises a support fixed to said ski wherein said elements of said support and said holding means have a V-shaped configuration, each leg of said V being symmetrical with respect to the vertical and longitudinal plane of symmetry of said binding.

40. The binding defined by claim 33 wherein said pivoting means comprises a support fixed to said ski wherein said pivoting means further comprises elastic means for biasing said at least two elements of said holding means and said support into contact.

41. The binding defined by claim 40 wherein said elastic means acts on said holding means.

42. The binding defined by claim 41 wherein said holding means comprises an axial bore housing said elastic means.

43. The binding defined by claim 42 wherein said support comprises an anterior portion comprising said at least two elements and said holding means further comprises a wall having first and second sides, said first side comprising one end of said axial bore against which said elastic means presses, and wherein said second side is adjacent said anterior portion of said support and comprises said at least two elements.

44. The binding defined by claim 41 wherein said elastic means is positioned on the exterior of said holding means.

45. The binding defined by claim 33 wherein said holding means lifts away from said ski as said holding means laterally pivots.

46. A method of laterally releasing a boot attached to a ski by a binding, comprising a jaw pivotally supported on a ski fixed support, said support comprising one of the members of the following group and said jaw comprising the other of the members of the following group wherein said group comprises at least one groove and at least one projection; wherein a portion of said jaw holds said boot and; wherein said one of said group faces away from said portion of said jaw, the method comprising the steps of:

(a) holding said boot with the portion of the jaw;

(b) biasing one of the members of said group into contact with the other of the members of said group ski (c) laterally pivoting said jaw around either one of two downwardly converging lines of support formed by said members of said group on said jaw and support.

47. The method defined by claim 46 wherein said method further comprises the steps of:

laterally pivoting said jaw around either one of two downwardly converging lines of support, each of which is positioned symmetrically with respect to the vertical and longitudinal plane of said binding.

48. The method defined by claim 46 wherein said jaw comprises a cavity and an anterior wall having posterior and anterior sides, forming one end of said cavity, and said support comprises an anterior portion, and wherein said method further comprises the steps of:

biasing said jaw into contact with said support by rearwardly biasing said anterior side of said wall such that said posterior side of said wall contacts said anterior portion of said support.

49. A support for a ski binding adapted to engage a jaw having a portion holding and engaging a boot on a ski wherein said jaw is adapted to laterally pivot and wherein said support comprises:

(a) means for attaching said support to a ski; and (b) first and second surfaces, wherein said first surface faces said portion of said jaw, wherein said second surface is opposite from said first surface, wherein said second surface comprises two downwardly converging lines of support thereon comprising means for pivoting said jaw around either one of said two lines of support, wherein each line of support comprises one of the following: at least one groove and at least one projection.

50. The support defined by claim 49 wherein said downwardly converging lines of support comprise:

(i) first and second projections, disposed symmetrically with respect to the vertical and longitudinal plane of said binding; and (ii) a third projection located on said vertical and longitudinal plane of symmetry of said binding, wherein said first and third projection comprise one line of support and said second and third projections comprise the other line of support.

51. The support defined by claim 50 wherein said jaw comprises complementary grooves thereon, and wherein said projections are adapted to engage said grooves.

52. The support defined by claim 49 wherein said surface comprises:

(i) first and second grooves disposed symmetrically with respect to a vertical and longitudinal plane of said binding; and (ii) a third groove located in the longitudinal and vertical plane of symmetry of said binding, wherein said first and third grooves comprise one line of support and said second and third grooves comprise said other line of support.

53. The support defined by claim 52 wherein said jaw comprises complementary shaped projections and wherein said grooves are adapted to engage said projections.

54. The support defined by claim 49 wherein said two lines of support comprise a V-shaped rib on said surface, wherein the legs of said V-shaped rib are disposed symmetrically about the longitudinal and vertical plane of symmetry of said binding.

55. The binding defined by claim 1, wherein said support comprises an anterior surface, and wherein said two downwardly converging lines of support are positioned on said anterior surface of said support.

56. The binding defined by claim 33, wherein said pivoting means comprises an anterior surface, and wherein said two downwardly converging lines of support are positioned on said anterior surface of said pivoting means.

57. The support defined by claim 49 wherein said surface comprises the anterior surface of said support.

* * * * *

UNITED STATES PATENT AND TRADEMARK OFFICE

CERTIFICATE OF CORRECTION

PATENT NO. : 4,639,011

DATED : January 27, 1987

INVENTOR(S) : Pierre RULLIER

It is certified that error appears in the above-identified patent and that said Letters Patent is hereby corrected as shown below:

Column 4, line 45, after "In addition" insert ---,---.

Column 4, line 47, delete "each".

Column 12, line 53, change "fourty" to ---forty---.

Signed and Sealed this

Twentieth Day of September, 1988

*Attest:*

DONALD J. QUIGG

*Attesting Officer*

*Commissioner of Patents and Trademarks*